US007810894B2

(12) United States Patent
Menendez et al.

(10) Patent No.: US 7,810,894 B2
(45) Date of Patent: Oct. 12, 2010

(54) HYBRID PRINTING DEVICE

(75) Inventors: Jorge Menendez, Barcelona (ES); Emilio Carlos Cano, Barcelona (ES); Lluis Hierro, Sant Llorens d'Hortons (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 719 days.

(21) Appl. No.: 11/727,969

(22) Filed: Mar. 29, 2007

(65) Prior Publication Data

US 2008/0238995 A1 Oct. 2, 2008

(51) Int. Cl.
*B41J 25/308* (2006.01)
*B41J 23/00* (2006.01)

(52) U.S. Cl. ..... 347/8; 347/37

(58) Field of Classification Search ..... 347/8, 347/37; 400/50–59

See application file for complete search history.

(56) References Cited

U.S. PATENT DOCUMENTS

| | | | | |
|---|---|---|---|---|
| 5,872,579 | A * | 2/1999 | Handa et al. | 347/8 |
| 6,575,543 | B2 * | 6/2003 | Ahn | 347/8 |
| 2001/0038401 | A1 * | 11/2001 | Kawase et al. | 347/42 |
| 2007/0109382 | A1 * | 5/2007 | Lafleche et al. | 347/102 |

OTHER PUBLICATIONS

Inkjet Printer, Printing and Imaging Solutions, OCÉ North America, 5 Sheets.

Illustration of an Exemplary Hybrid Printer Device; 1 Sheet.

* cited by examiner

*Primary Examiner*—Julian D Huffman
*Assistant Examiner*—Jason S Uhlenhake

(57) ABSTRACT

A hybrid printer adapted to print onto roll-based print media and rigid print media is presented. The printer comprises a print head that is movable along at least one substantially horizontal scan axis; and drive means adapted to drive lifting means. The lifting means are arranged to cause the scan axis to undergo movement in a substantially vertical direction when driven by the drive means, thereby enabling a distance between the print head and the print media to be adjusted.

14 Claims, 7 Drawing Sheets

HYBRID PRINTING DEVICE

FIELD OF THE INVENTION

This invention relates to the field of printing, and more particularly to the field of hybrid printing devices which are able to print onto roll-based print media and flat rigid print media.

BACKGROUND

Printing devices for large format printing can be categorized according to the type of print media they are adapted to print onto and the manner in which the print media is moved during the printing process.

Roll-to-roll printers typically print onto roll-based print media and convey the print media from a first (feed) roller to second roller or basket. Flatbed printers, on the other hand, typically print onto rigid and flat print media with the print media being fixed to a table and the print head of the printer being moved across the print media during the printing process.

In general, a roll-to-roll printer may be preferred for printing onto flexible print media, such as paper, thin plastic film, clothing, etc., whereas a flatbed printer may be preferred for printing onto rigid print media, such as thick plastic, wood, glass, etc.

Advances in the field of large format printing have led to the development of hybrid printers which are able to print onto both roll-based print media and flat rigid print media. Such hybrid printers combine the functionality of a roll-to-roll printer and a flatbed printer in a single machine, thereby reducing cost and space requirements whilst maintaining the advantages associated with each printing type. This is important since large format printers may be over 5 m in width to cater for large format media and, accordingly, may also be very heavy and expensive.

An illustration of an exemplary hybrid printer device is shown in FIG. 1. The hybrid printer 1 comprises a table structure having a flat surface 4 upon which flat print media 6 can be positioned and secured. The printer also comprises a scan axis assembly 8 which is positioned above the flat surface 4 and adapted to guide the movement of a print head 2 coupled thereto. More specifically, the scan axis assembly 8 comprises an elongate member that extends in a lateral axis (as indicated generally by the arrow labeled "L") above the flat surface 4 and is adapted to guide movement of the print head 2 in the lateral axis L. The scan axis assembly 8 is also adapted to be movable in a controlled manner along a longitudinal axis (as indicated generally by the arrow labeled "M") of the flat surface 4.

The scan axis assembly 8 of the exemplary hybrid printer may be over 5.5 meters long and may weigh over 500 kg, for example.

By controlling the movement of the scan axis assembly 8 and the print head 2 along their respective axes whilst the print head 2 is also controlled to print, flat print media 6 secured on the flat surface 4 can be printed onto as required.

The hybrid printer 1 also comprises a feed roller 9 positioned at one end of the table structure and a rear roller (not visible) positioned adjacent to the feed roller 9. Roll-based flexible print media may then be fed from the feed roller 9 past the print head 2. Such roll-based flexible print media can then be printed onto by moving the print head 2 back and forth along the lateral axis L and controlling the print head 2 to print as the flexible print media is fed from the feed roller 9 to the rear roller past the print head 2.

Thus, it will be understood that the hybrid printer 1 of FIG. 1 combines the functionality of a roll-to-roll printer and a flatbed printer in a single printing machine.

Despite the advantages associated with hybrid printers, they also exhibit some drawbacks. One such drawback is that existing hybrid printers are generally unable to cater for print media of differing thicknesses due to their size and weight and the positioning accuracy required. In other words, they do not allow the optimization of Print-head to Print-media Spacing (PPS).

Thus, there is a need to design a hybrid printer that can cater for print media of differing thicknesses, and therefore enable a PPS to be adjusted as necessary. It is also desirable that such a printer is able to print with high accuracy, independently of the thickness of the print media.

BRIEF DESCRIPTION OF THE DRAWINGS

For a better understanding of the invention, embodiments will now be described, purely by way of example, with reference to the accompanying drawings, in which.

DETAILED DESCRIPTION OF THE INVENTION

Figure 1:
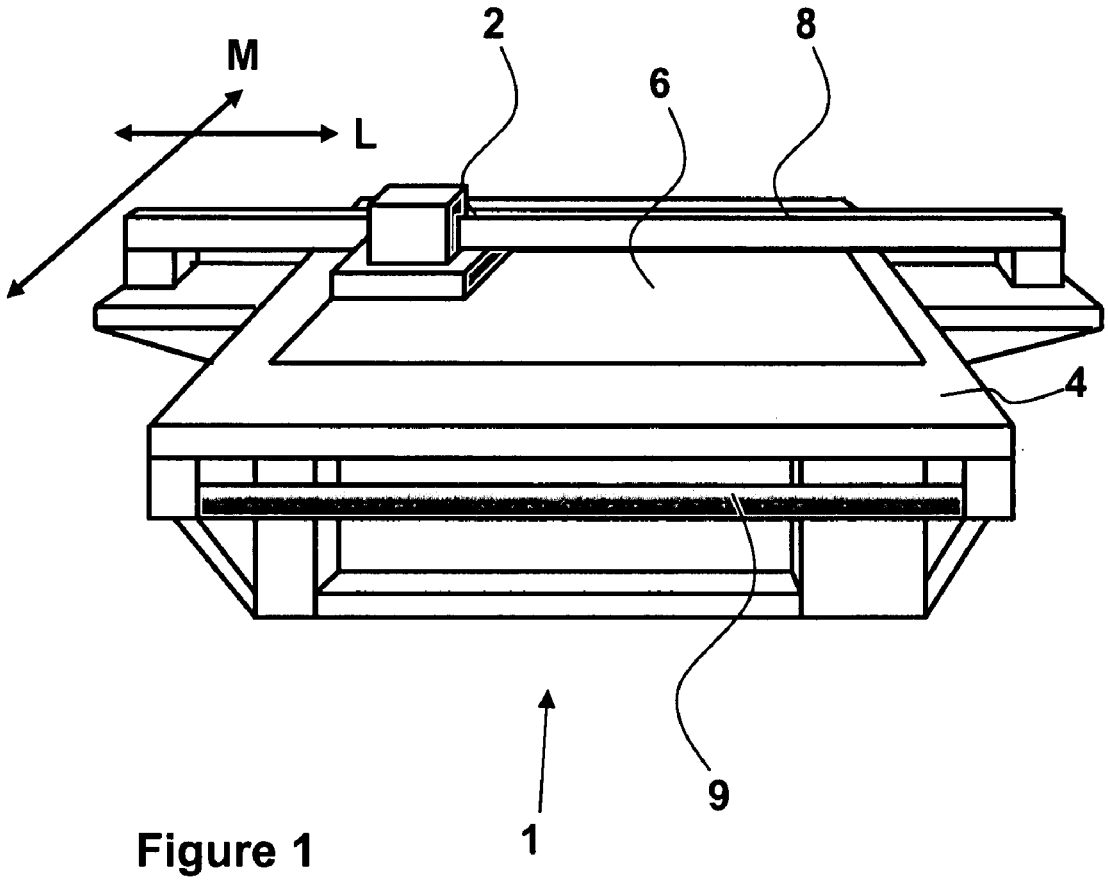
FIG. 1 is an illustration of a conventional hybrid printer which is able to print onto roll-based media and flat rigid media.

According to an aspect of the invention, there is provided a hybrid printer adapted to print onto roll-based print media and rigid print media, the printer comprising: a print head that is movable along at least one substantially horizontal scan axis; and drive means adapted to drive lifting means, wherein the lifting means are arranged to cause the scan axis to undergo movement in a substantially vertical direction when driven by the drive means, thereby enabling a distance between the print head and the print media to be adjusted.

While the present invention is susceptible of embodiment in various forms, there is shown in the drawings and described presently preferred embodiments. These embodiments are provided so that this disclosure will be thorough and complete, and will convey fully the scope of the invention to those skilled in the art. Like reference numerals refer to like elements throughout.

Figure 2:
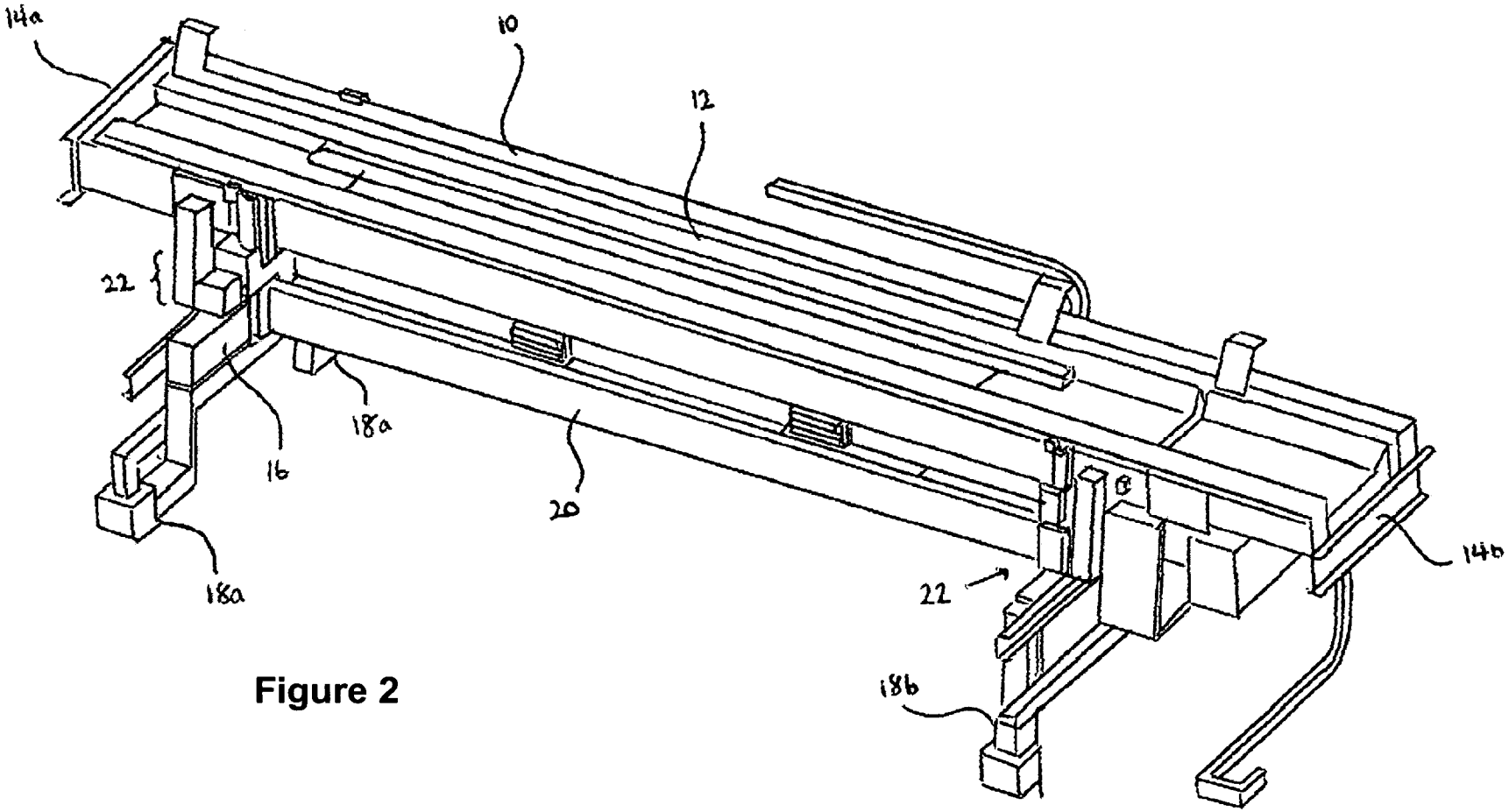
FIG. 2 is a perspective diagram of a hybrid printer according to an embodiment of the invention, wherein the print head is not shown.
Figure 3:
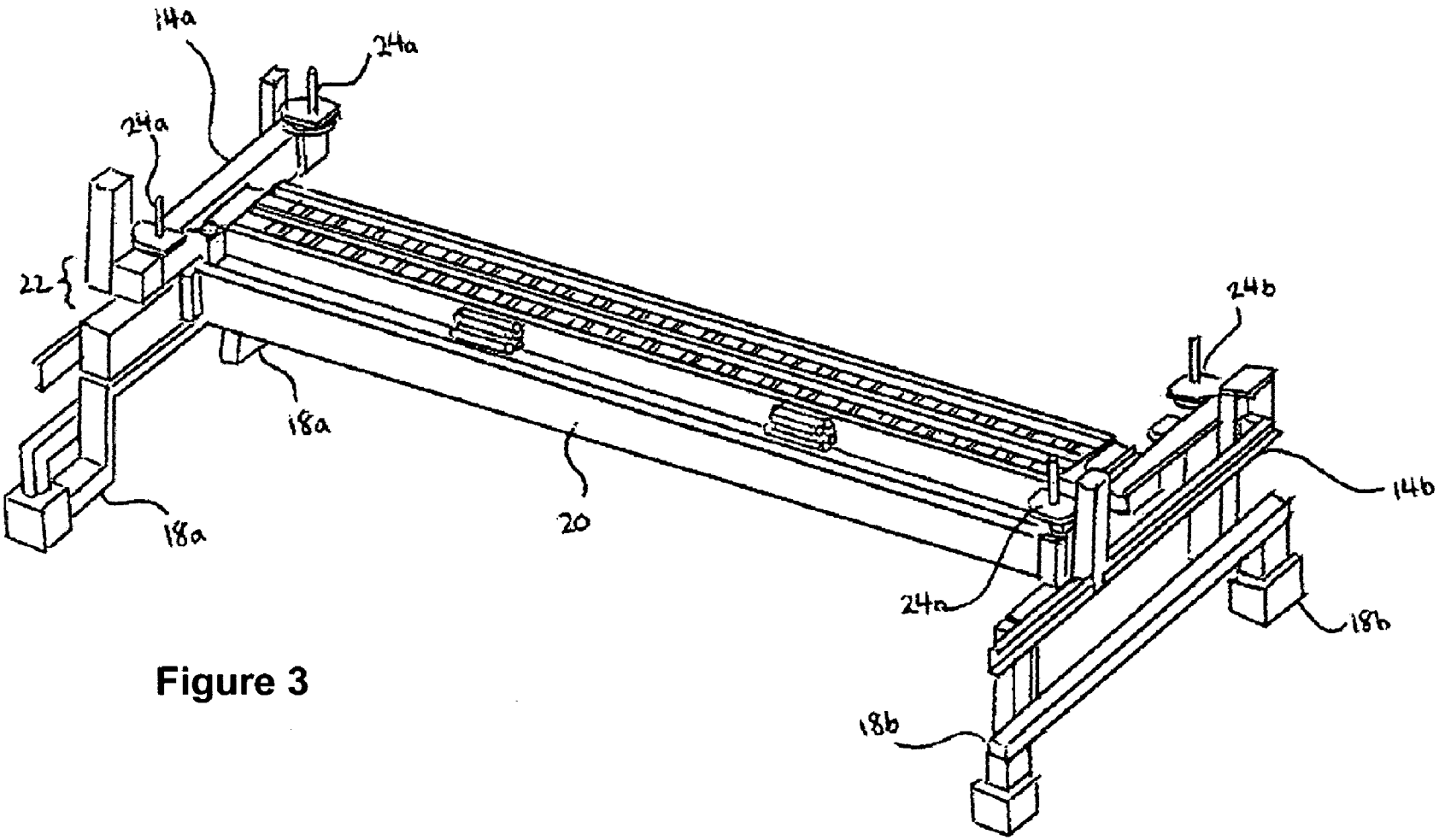
FIG. 3 shows the hybrid printer of FIG. 2, wherein a scan axis assembly has been removed so that drive means and lifting means are visible.

Referring to FIGS. 2 and 3, a hybrid printer according to an embodiment of the invention comprises a print head (not shown) that is movable along an elongated scan axis assembly 10.

The scan axis assembly 10 comprises an elongate support member 12 that extends laterally between a left end 14*a* and a right end 14*b* and is adapted to support the print head in a generally lateral and horizontal scan axis along which the print head is movable.

The scan axis assembly 10 is supported by a base 16 comprising two laterally spaced apart pair of legs 18*a* and 18*b* and a cross member 20 bridging the two pairs of legs. Thus, the base 16 is an elongated frame generally extending in a lateral direction (from the left end 14*a* to the right end 14*b*), therefore extending in the same general direction as the scan axis assembly 10.

The base 16 also comprises drive means 22 mounted thereon, the drive means being adapted to drive lifting means 24 (see FIG. 3). The lifting means 24 comprise first 24*a* and second 24*b* pairs of bolts coupled to base 16 and the scan axis assembly 10. The first pair of bolts 24*a* is fixedly attached to the left end 14*a* of the base 16 such that the shaft of each bolt projects in a substantially vertical direction and the bolts are longitudinally separated from each other. The second pair of bolts 24*b* is fixedly attached to the right end 14*b* of the base 16 such that the shaft of each bolt projects in a substantially vertical direction and the bolts are longitudinally separated from each other.

The lifting means 24 also comprise four nuts (not visible), each nut being threaded on a different bolt. Each nut is also coupled to a respective different corner of the scan axis assembly 10 such that the lifting means 24 cause the scan axis assembly 10 to undergo movement in a substantially vertical direction when driven by the drive means 22.

More specifically, in the example shown, the drive means 22 are adapted to rotate each nut about the vertically arranged shaft axis of the bolt that the nut is threaded on, thereby causing the nut to move along the shaft. By arranging the nuts to be turned in the same direction of rotation at once (assuming the bolts are of the same left-handed or right-handed type), all four corners of the scan axis assembly 10 may be caused to undergo substantially the same vertical movement at the same time. Of course, it will also be understood that the drive means 22 may also be adapted to rotate the nuts independently of each other, and/or in opposing directions, such that the vertical location of each corner of the scan axis assembly 10 may be adjusted as necessary.

By enabling the scan axis assembly 10 to undergo movement in a substantially vertical direction, a vertical distance between the base 16 and the scan axis assembly 10 can be adjusted as necessary. Since the scan axis assembly 10 is arranged to support and guide lateral movement of the print head, and the cross member 20 of the base 16 is adapted to support print media, a distance between the print head and the print media can be adjusted as necessary. In other words, the invention enables a Print-head to Print-media Spacing (PPS) to be optimised.

For hybrid printers a range of PPS is preferably greater than 20 mm, more preferably greater than 50 mm, and most preferably greater than 100 mm. Since the scan axis assembly 10 of a hybrid printer is typically large and heavy (i.e. over 5 m long and over 500 kg in weight), conventional hybrid printers do not provide such preferred PPS ranges, especially to suitable positioning accuracy. A hybrid printer according to the invention, on the other hand, may provide a range of PPS over 220 mm, and more preferably over 120 mm, and enable the PPS to be adjusted to a preferred degree of tolerance or accuracy.

Figure 4:
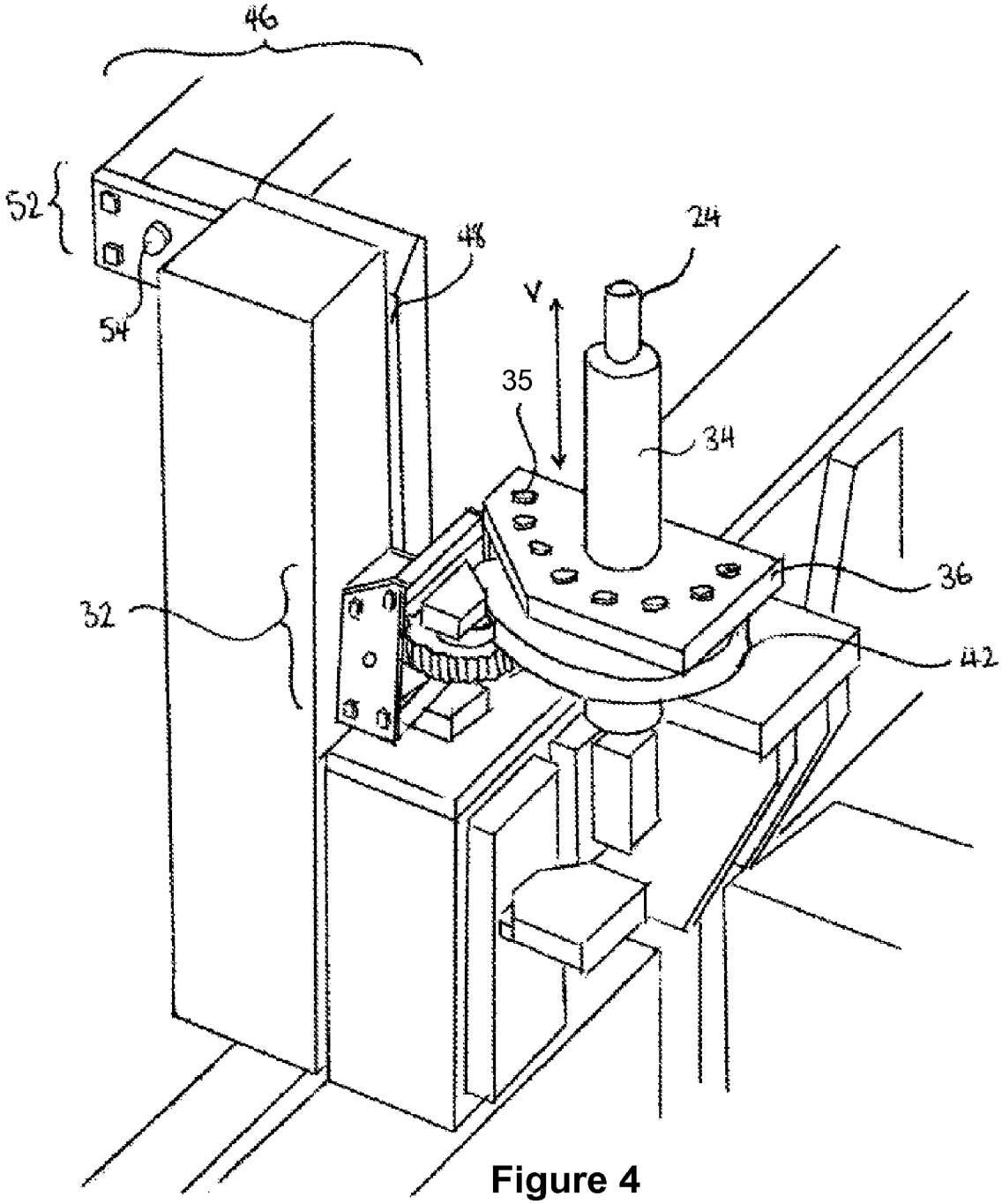
FIG. 4 is a perspective diagram of drive and lifting means according to an embodiment of the invention.
Figure 5:
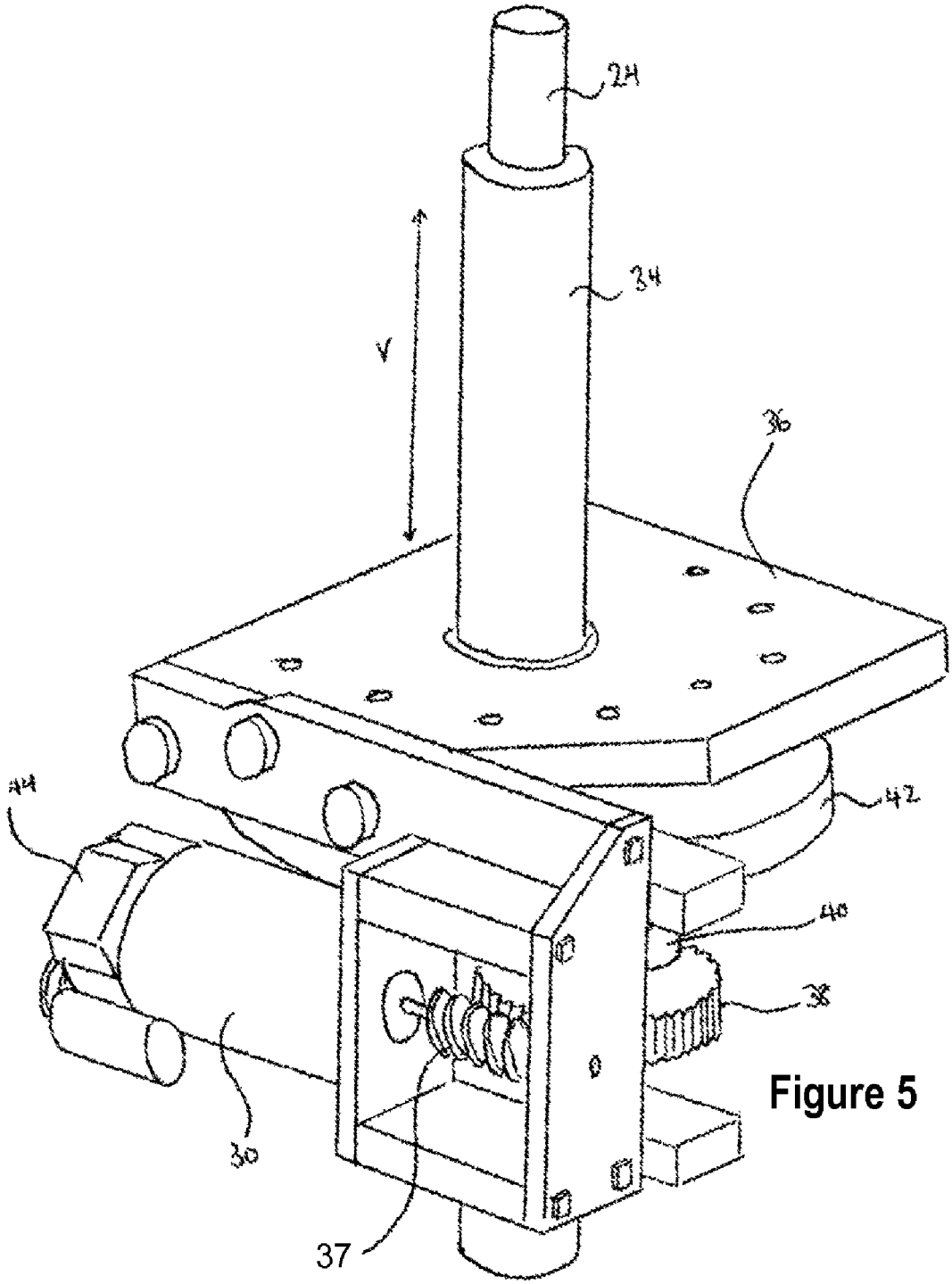
FIG. 5 shows an alternative view of the drive and lifting means of FIG. 4.
Figure 6:
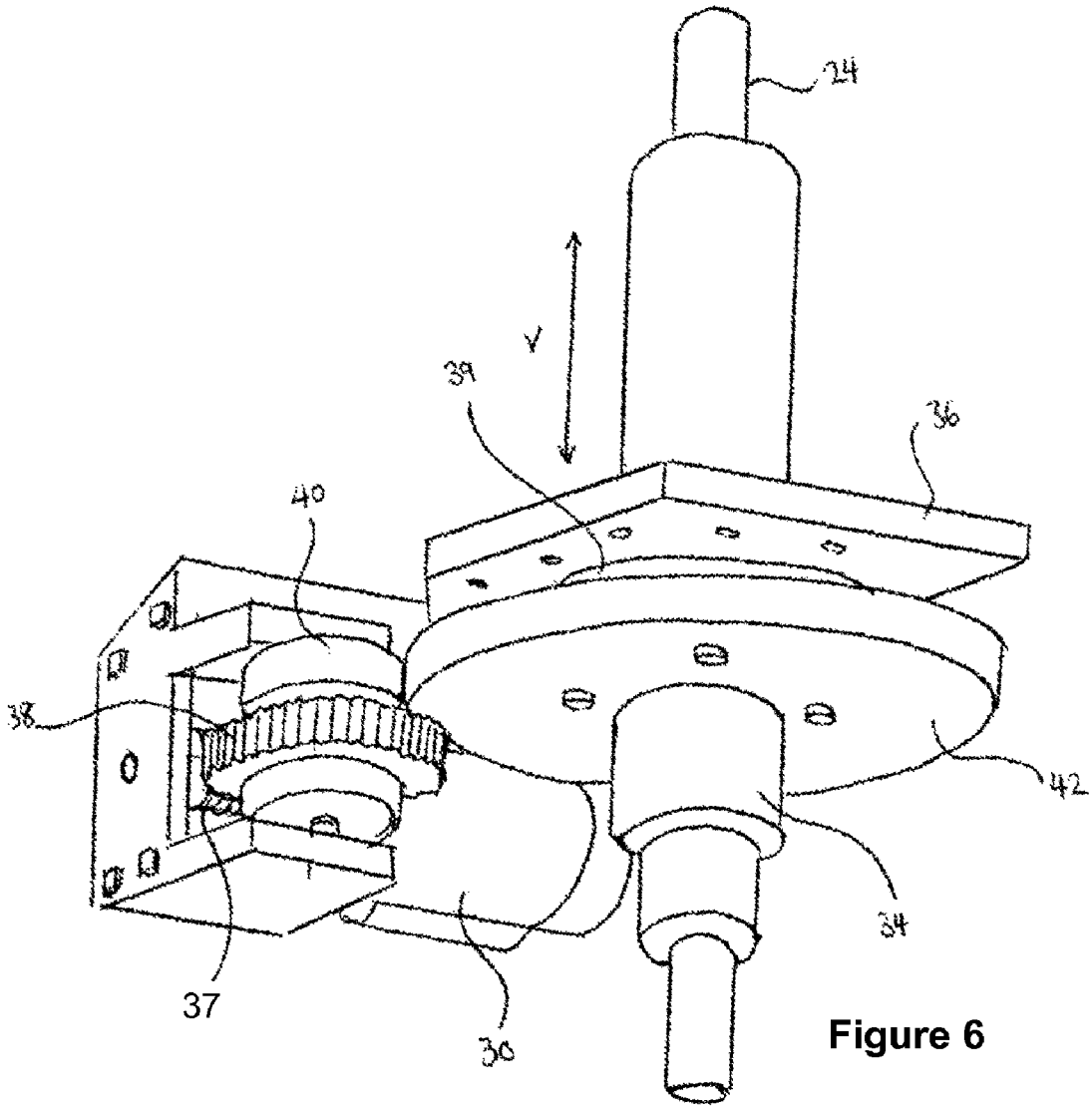
FIG. 6 shows a further view of the drive and lifting means of FIG. 4.

Turning now to FIGS. 4, 5 and 6, a more detailed example of drive means and bolt means according to the invention will now be described. The drive means 22 comprises a motor 30 and a gear arrangement 32, wherein the gear arrangement is coupled to the nut 34 threaded on a bolt 24. Thus, the gear arrangement 32 is adapted to rotate the nut 34 about the shaft axis of the bolt 24 so that the nut 34 can be threaded along the shaft of the bolt 24.

Further, the scan axis assembly (not shown in FIGS. 4 to 6) is coupled to a support plate 36 using suitable attachment means 35, and the support plate is coupled to the nut 34, via a washer 39. The washer 39, support plate 36 and the scan axis assembly are adapted to slide along the vertical shaft axis of the bolt 24 so that they undergo substantially vertical movement (as indicated generally by the arrow labeled "V") when the nut 34 is threaded along the shaft of the bolt 24.

The gear arrangement 32 comprises a worm gear 37, a helical gear 38 arranged to engage with the worm gear 37, and first 40 and second 42 spur gears, wherein the first spur gear 40 is arranged to turn with the helical gear 38 and the second spur gear 42 is arranged to engage with the first spur gear 40 while turning around and moving up and down of bolt 24.

The rotor of the motor 30 is adapted to cause the worm gear 37 to rotate about its shaft axis, thereby causing the helical gear 38 and the first 40 and second 42 spur gears to rotate. The second spur gear 42 is coupled to the nut 34 and is adapted to rotate the nut 34 about the shaft axis of the bolt 24 when the second spur gear 42 rotates. It will therefore be understood that the motor 30 is used to drive the gear arrangement 32 which, in turn, causes the nut 34 to be threaded along the shaft of the bolt 24.

In the illustrated embodiment, one revolution of the motor rotor is divided into M subunits of equal angle and the drive means 22 further comprise an encoder unit 44. The encoder unit 44 is adapted to control the motor 30 so that the motor 30 is restricted to rotating the rotor by an integer number of subunits.

Furthermore, the gear arrangement 32 is designed to have a step-down gearing-ratio (i.e. one revolution of the motor rotor causes less than one revolution of the nut 34), and preferably the step-down gearing ratio is of a high value, for example N:1 where N is the number of revolutions of the motor rotor required to cause the nut 34 to undergo one revolution and N is substantially greater than 1. By way of example, the gearing ratio may be greater than 10:1, is preferably greater than 50:1, and is even more preferably greater than 100:1.

Thus, by controlling the rotor of the motor 30 to only turn in subunits of one revolution, and by adapting the gear arrangement such that a plurality of revolutions of the rotor are required to rotate the nut by one revolution, threading of the nut 34 along the shaft of the corresponding bolt 24 can be accurately adjusted and controlled.

By way of example, the drive means of FIGS. 4, 5 and 6 are arranged to have a gearing ratio of 148:1 (i.e. N=148), one revolution of the motor rotor is divided into 2000 subunits (i.e. M=2000), and the bolt 24 has a lead of 6 mm. Thus, the encoder unit 44 must control the motor rotor to rotate by 296,000 subunits (148×2000) in order to cause the nut 34 to rotate about the shaft axis of the bolt 24 by one revolution. Since one revolution of the nut 34 will result in the nut 34 moving 6 mm along the shaft axis of the bolt 24, the encoder unit 44 must control the motor rotor to rotate by 49,333 subunits (296,000÷6) to cause the nut 34 to move along the shaft axis of the bolt 24 by 1 mm. Thus, approximately 1 μm (1 micron) movement of the nut 34 along the shaft axis of the bolt 24 corresponds to rotating the motor rotor by 49 subunits (49,333÷1000).

Control of the motor 30 using the encoder unit 44 may be achieved by using a dedicated electronic board for the motor 30 together with an input/output circuit board which is arranged to interface with a computer via a suitable connection (i.e. a serial connection, a parallel connection, a Universal Serial Bus (USB), wireless connection, etc.). Thus, the drive means 22 may be monitored and dynamically controlled to ensure that resultant movement of the scan axis assembly is as required. Further, if independent drive means 22 are employed for each lifting means 24, the separate drive means may be monitored and controlled so that any loading is equally shared in order to reduce or prevent twisting of the scan axis assembly 10.

It will therefore be understood that the invention enables the position of the nut 34 on the vertically arranged shaft axis of the bolt 24 to be accurately adjusted and controlled, thereby enabling the vertical position of the scan axis assembly 10 (which the nut 34 supports) to also be accurately adjusted and controlled. The invention therefore enables fine adjustment of the PPS.

Figure 7:
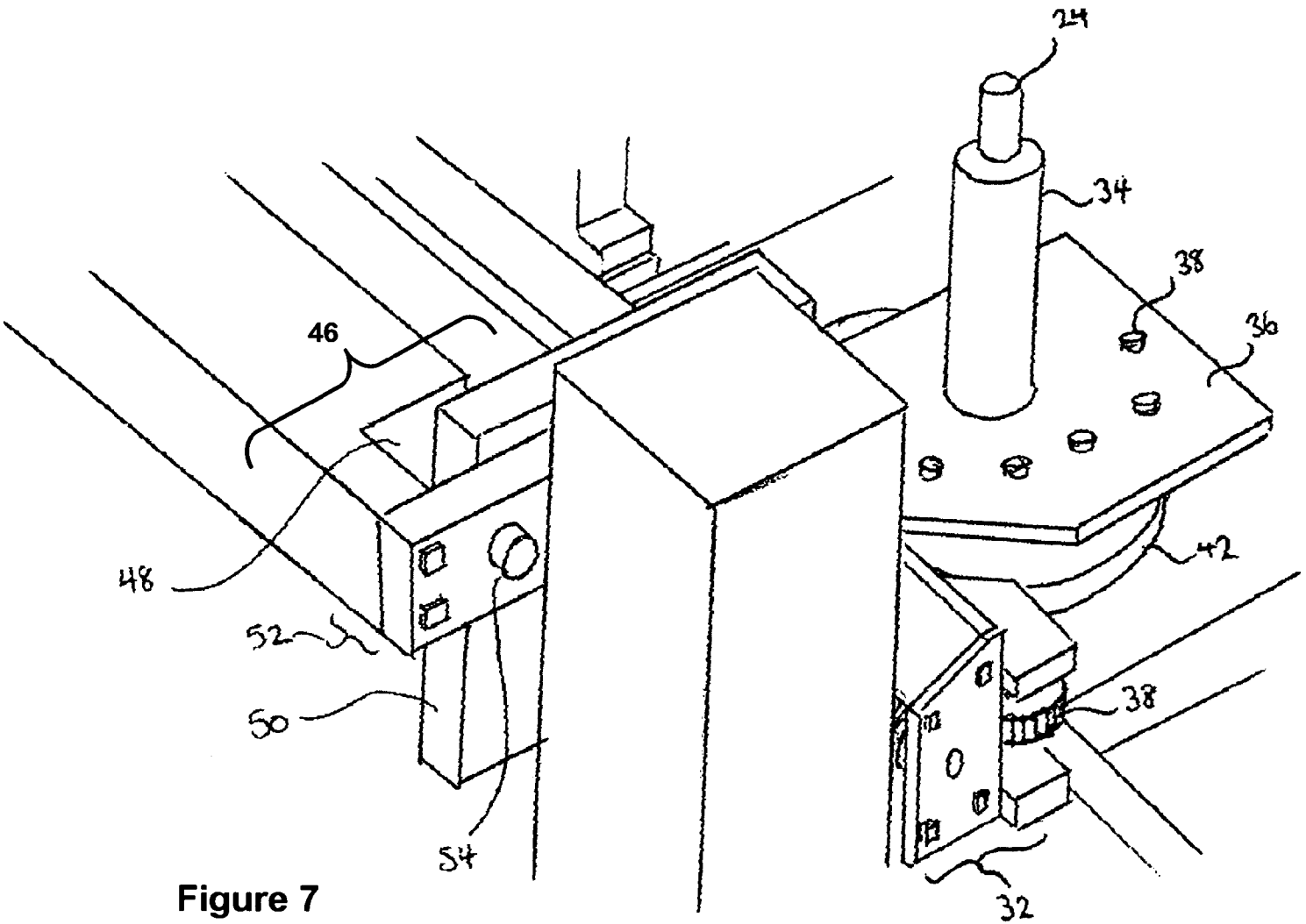
FIG. 7 is a perspective diagram of drive and lifting means according to an embodiment of the invention.

As shown in FIG. 7, the drive means may further comprise a guidance and braking arrangement 46 which can be used to restrict the movement of the scan axis assembly 10.

When being driven to move vertically, it is possible that the scan axis assembly 10 may also move laterally and/or longitudinally within the limits of the guidance system. Further, if the lifting means 24 are independently driven, the scan axis assembly may also rotate or twist about a vertical axis. Such small movements prevent jamming of the scan axis assembly 10 for example.

The guidance and braking arrangement 46 is therefore provided with a guide channel 48 within which a flange 50 coupled to the drive means 22 and/or the scan axis assembly 10 extends. The guide channel 48 is adapted to receive the flange 50 so that the guide channel 48 and flange 50 cooperate to restrict large lateral and/or longitudinal movement of the flange 50. Despite closely fitting the flange 50, the guide channel 48 may be formed to have a suitable spacing from the flange 50 so that there is suitable play therebetween, thereby enabling small adjustments in the lateral and/or longitudinal position of the flange (and therefore the drive means 22 and/or the scan axis assembly) to be made.

Once a desired vertical position of the scan axis assembly 10 has been attained by suitably driving and controlling the drive means 22 coupled to the lifting means 24, the longitudinal position of the scan axis assembly 10 can be adjusted to a desirable position by bringing the scan axis to a datum in longitudinal direction by using a clamping arrangement 52 to clamp the flange 50. In the embodiment of FIG. 7, the clamping arrangement is formed from the opposing sides of the guide channel 48 being adapted to be urged towards each other by turning screw means 54 that pass through the opposing surface of the guide channel 48. The flange 50 is clamped into a desired longitudinal position by sandwiching it between the opposing sides of the guide channel 48 and turning the screw means 54 so as to urge the sides of the guide channel 48 against the flange 50 to secure it therebetween.

Similarly, a clamping arrangement may be employed secure the scan axis assembly 10 in a desired lateral position and/or desired position in relation to a vertical axis of twist.

While specific embodiments have been described herein for purposes of illustration, various modifications will be apparent to a person skilled in the art and may be made without departing from the scope of the invention.

We claim:

1. A hybrid printer adapted to print onto roll-based print media and rigid print media, the printer comprising:

a print head that is movable along at least one scan axis; and a driver adapted to drive a lifter, wherein the lifter is arranged to cause the scan axis to undergo movement in a direction substantially perpendicular to the scan axis when driven by the driver to enable a distance between the print head and the print media to be adjusted, wherein the driver includes a gear arrangement operatively coupled to the lifter, the gear arrangement having a worm gear operatively coupled to a helical gear, and first and second spur gears, the first spur gear being arranged to engage with the helical gear and the second spur gear being arranged to engage with the first spur gear and the lifter.

2. A hybrid printer according to claim 1, wherein the lifter comprises four or more bolts each having a nut threaded thereon.

3. A hybrid printer according to claim 1, wherein the driver further comprises a motor.

4. A hybrid printer according to claim 3, wherein the motor is adapted to cause the worm gear to rotate, thereby causing the helical gear and the first and second spur gears to rotate to drive the lifter.

5. A hybrid printer according to claim 3, wherein one revolution of the motor rotor is divided into M subunits of equal angle, and wherein the driver further comprise an encoder unit adapted to control the motor rotor to rotate by an integer number of subunits.

6. A hybrid printer according to claim 5, where M is greater than or equal to 100.

7. A hybrid printer according to claim 1, wherein the gear arrangement is arranged to have a gearing ratio greater than 10:1.

8. A hybrid printer according to claim 1, further comprising a locater adapted to restrict movement of the scan axis in one or more directions.

9. A method of adjusting a distance between a print head of a hybrid printer and print media to be printed thereon, the hybrid printer being adapted to print onto roll-based print media and rigid print media, the method comprising:

driving a lifter via a driver to cause a scan axis along which the print head is movable to undergo movement in a direction substantially perpendicular to the scan axis, wherein the driver includes a gear arrangement that includes a worm gear and a helical gear operatively coupled to the lifter and a first spur gear being arranged to engage with the helical gear and a second spur gear being arranged to engage with the first spur gear and the lifter, and wherein driving the lifter comprises rotating the worm gear to cause the helical gear and the first and second spur gears to rotate.

10. A method according to claim 9, wherein driving the lifter comprises rotating the gear arrangement via a motor to cause the lifter to move in the direction substantially perpendicular to the scan axis.

11. A method according to claim 10, wherein one revolution of the motor rotor is divided into M subunits of equal angle, and wherein driving the lifter comprises controlling the motor rotor to rotate by an integer number of subunits.

12. A method according to claim 9, further comprising restricting movement of the scan axis in one or more directions.

13. A method as defined in claim 9, wherein driving the lifter is implemented using a non-transitory computer readable medium.

14. A hybrid printer adapted to print onto roll-based print media and rigid print media, the printer comprising:

a print head that is movable along at least one substantially horizontal scan axis; and a drive means adapted to drive lifting means, wherein the lifting means are arranged to cause the scan axis to undergo movement in a substantially vertical direction when driven by the drive means, thereby enabling a distance between the print head and the print media to be adjusted, wherein the drive means comprises a motor and a gear arrangement, wherein the gear arrangement includes:

a worm gear;

a helical gear arranged to engage with the worm gear; and first and second spur gears, the first spur gear being arranged to engage with the helical gear and the second spur gear being arranged to engage with the first spur gear and the lifting means, and wherein the motor is adapted to cause the worm gear to rotate, thereby causing the helical gear and the first and second spur gears to rotate.

* * * * *